US008585311B2

(12) United States Patent
Brennan et al.

(10) Patent No.: US 8,585,311 B2
(45) Date of Patent: Nov. 19, 2013

(54) RECYCLABLE RING BINDER APPARATUS WITH QUICK RELEASE RING METALS

(75) Inventors: Brian R. Brennan, Verdi, NV (US); Patrick H. Brennan, Albuquerque, NM (US)

(73) Assignee: Stride Manufacturing, LLC, Reno, NV (US)

( * ) Notice: Subject to any disclaimer, the term of this patent is extended or adjusted under 35 U.S.C. 154(b) by 488 days.

(21) Appl. No.: 12/134,844

(22) Filed: Jun. 6, 2008

(65) Prior Publication Data

US 2009/0304436 A1 Dec. 10, 2009

(51) Int. Cl.
*B42F 13/00* (2006.01)

(52) U.S. Cl.
USPC ..... 402/75

(58) Field of Classification Search
USPC ..... 402/75
See application file for complete search history.

(56) References Cited

U.S. PATENT DOCUMENTS

| | | | | |
|---|---|---|---|---|
| 3,262,454 | A * | 7/1966 | Shillinger | 402/75 |
| 3,262,455 | A * | 7/1966 | Shillinger | 402/75 |
| 6,386,784 | B1 | 5/2002 | Ruble | 402/60 |
| 6,746,171 | B2 * | 6/2004 | Welch | 402/75 |
| 2007/0048075 | A1 * | 3/2007 | Cheng et al. | 402/75 |
| 2008/0226385 | A1 * | 9/2008 | Ruble | 402/75 |

* cited by examiner

*Primary Examiner* — Kyle Grabowski
(74) *Attorney, Agent, or Firm* — Holland & Hart LLP

(57) ABSTRACT

A recyclable ring binder apparatus comprises a ring metal incorporating a set of binder rings that are formed of a pair of ring halves. The ring metal can be firmly fastened to a spine section of a binder hardcover by utilizing a post and a small arched snap clamp with a tap. The tap of the snap clamp can be pressed around a neck of the post utilizing a quick release clipping mechanism. The snap clamp can be accessed with an index finger and slid away from the post to remove the ring metal from the hardcover. The ring metal, the hardcover, the snap clamp and the post can be quickly separated into their perspective categories due to the clipping mechanism. Hence, it retains conformance of all components of the ring binder apparatus for recycling without increasing development and production cost.

20 Claims, 2 Drawing Sheets

FIG. 3

RECYCLABLE RING BINDER APPARATUS WITH QUICK RELEASE RING METALS

TECHNICAL FIELD

Embodiments are generally related to binders for maintaining loose-leaf paper. Embodiments are also related to recyclable ring binders for binding loose-leaf papers to form books or booklets. Embodiments are additionally related to quick release ring components and accessories utilized in the context of recyclable binders.

BACKGROUND OF THE INVENTION

Many different techniques, such as, for example comb binders, spiral wire binders, coil binders, paper clips or staples, three-ring binders, pocket organizers and mechanical binders, are utilized to bind and organize printed paper materials and form a book binding. Such binders and devices are utilized in virtually every factory, office, school and home. Typical considerations in the use of such binders include cost, ease of use, and the ability to stand, label and protect the bound materials as well as the ability to bind the paper materials on-site in a timely manner.

Three-ring binders are a popular means of binding and organizing printed paper materials, and commonly comprise a binder hardcover and a ring binding mechanism. The ring binding mechanism includes a base, to which a set of rings is connected. Each ring can exhibit two semi-circular prongs that are mated at one point to form a generally circular ring. Mating ends of each ring can be separated at the mating point to permit the insertion of papers or other articles for storage within the binder.

Moreover, the base of the ring binding mechanism may be permanently attached to the hardcover. The hardcover provides protection for the papers maintained by the rings within the binder. The hardcover is commonly constructed utilizing, but not limited to synthetic, plastic-type materials and paperboard. The useful life of the three-ring type binder can end upon failure of the hardcover or the binding mechanism. Therefore, in the event of failure, the binding mechanism cannot be easily removed from the hardcover for recycling. Such a removal process requires additional tools, which leads to additional costs and is also time-consuming. Hence, such a device creates a problem of non-conformance of a product for recyclers due to damage of the binding mechanism, the hardcover and/or other related accessories. Such a damaged hardcover and/or metal rings are very difficult to interchange with different types of binding mechanisms.

In one prior art implementation, an interchangeable ring binder can be removably mated with a variety of binding mechanisms. Such an approach results in the reusing of the ring metals and not the hardcover, since the ring metals are permanently bonded with the hardcover utilizing suitable bonding materials. The ring metals may actually damage the hardcover, when the ring metals are removed from the hardcover. In the majority of prior art binder applications, such binders suffer certain disadvantages such as being non-recyclable, of high cost, time consumption, or the need for relatively complex tools for the binder removal process. Therefore, it is desirable to solve the problem of non-conformance of binder for recyclers.

In an effort to address the foregoing difficulties, it is believed that a need exists for an inexpensive and recyclable binder apparatus with quick release ring metals and accessories. It is believed that the recyclable binder apparatus disclosed herein can address these and other continuing needs.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an inexpensive and 100% recyclable ring binder apparatus for binding loose-leaf papers to form books or booklets.

It is another aspect of the present invention to provide for quick release ring metals and a clipping mechanism utilized in the context of a recyclable ring binder apparatus.

The aforementioned aspects and other objectives and advantages can now be achieved as described herein. A recyclable ring binder apparatus is disclosed, which includes a ring metal incorporating a set of binder rings formed from a pair of ring halves. The ring metal can be firmly fastened to a spine section of a binder hardcover utilizing a post and a small arched snap clamp with a tab and an opening or rounded portion. The opening or rounded of the snap clamp can be pressed around a neck of the post utilizing a quick release clipping mechanism. The snap clamp can be accessed with an index finger and slid away from the post to remove the ring metal from the hardcover. The ring metal, the hardcover, the snap clamp and the post can be quickly separated into their perspective categories due to the clipping mechanism. Hence, such an approach retains conformance of all components with respect to the ring binder apparatus for recycling without increasing development and production cost. The ring metal can go into the metal recycle bin and the paper board or the plastic cover can go in their respective recycling bins.

Furthermore, the recyclable ring binder apparatus disclosed can be flat and bound much like a hard back book utilizing recycled paper or cloth tape. The recyclable ring binder can be utilized for binding loose-leaf papers to form books or booklets. The binder hardcover can be designed, for example, as a chipboard and/or a plastic board, where the plastic board can be constructed of bio-degradable or recycled plastics. A set of release levers can be located at each end of the ring metal and operable by a user to open and close the binder rings. Such ring binders can be easily detached without the need for additional tools. Hence, the disclosed ring binder apparatus is recyclable, environmentally and ecologically friendly, and reusable.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
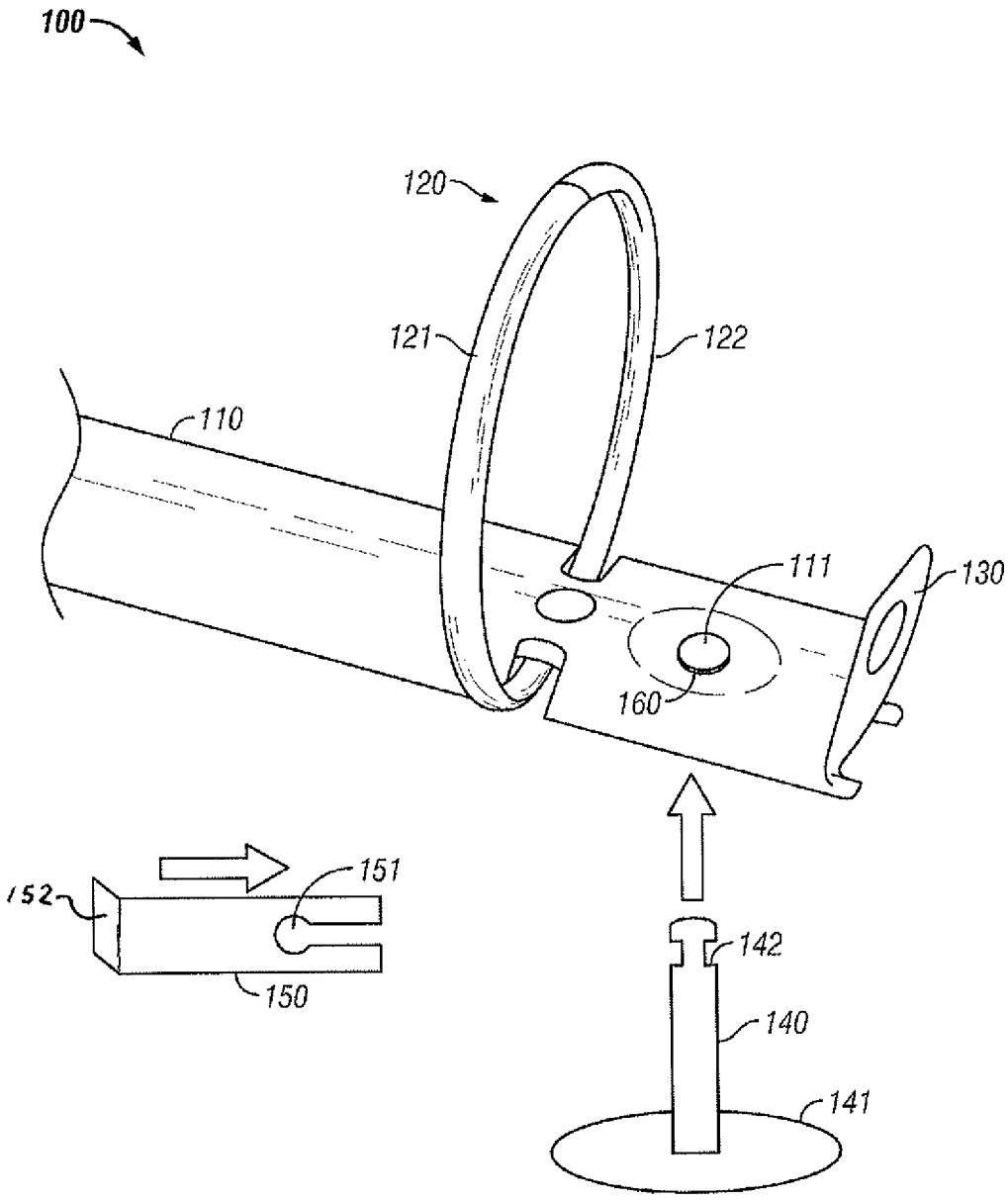
FIG. 1 illustrates an exploded view depicting individual components of a recyclable ring binder apparatus, in accordance with a preferred embodiment.

Referring to FIG. 1, an exploded view depicting individual components of a recyclable ring binder apparatus 100 is illustrated, in accordance with a preferred embodiment. The recyclable ring binder apparatus 100 can be flat and bound much like a hard back book utilizing a recycled paper or cloth tape (not shown). The recyclable ring binder apparatus 100 can be utilized for binding loose-leaf papers (not shown) to form books or booklets. The recyclable ring binder apparatus 100 comprises a ring metal 110, a post 140, and a small arched snap clamp 150 with a central opening or rounded portion 151 and a tab 152 and a clipping mechanism 160. The ring binder apparatus 100 can be available in various sizes to accommodate different sized sheets of paper and different quantities of paper.

The ring metal 110 can incorporate a set of binder rings 120 that are formed of a pair of ring halves 121 and 122. The set of binder rings 120 can be openable and closeable to hold the loose-leaf papers within the ring binder 100. The binder rings 120 can be spaced axially along the length of the ring metal 110. The ring binder 100 may have three or more binder rings 120 without departing the scope of the invention. A set of release levers 130 can be mounted on opposite ends of the ring metal 110. The set of release levers 130 can be operable by a user to open and/or close the binder rings 120 for easily and quickly loading the loose-leaf papers. Each release lever 130 can extend longitudinally of and co-planar with the ring metal 110.

Figure 2:
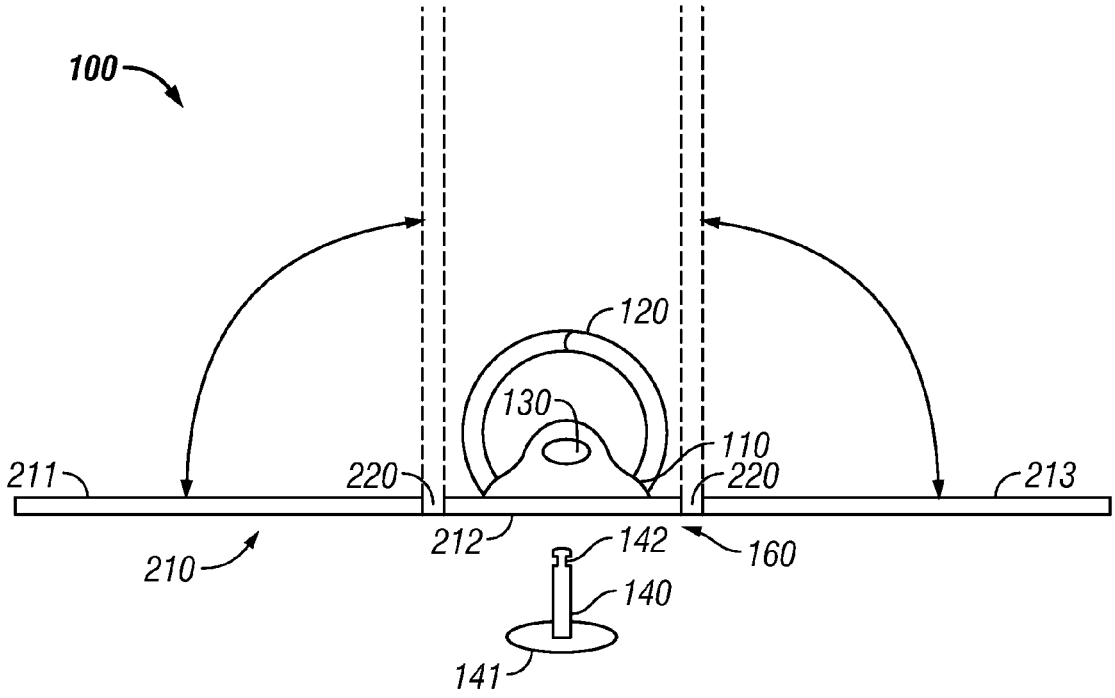
FIG. 2 illustrates a bottom view of the recyclable ring binder apparatus in a fully opened position, in accordance with a preferred embodiment.

The ring metal 110 can be firmly fastened to a spine section 212 of a binder hardcover 210, as illustrated in FIG. 2, by utilizing the post 140 and the small arched snap clamp 150. The post 140 can include a head 141 and a neck 142 formed therein. The ring metal 110 can also include a hole 111 that are formed therein to receive the neck 142 of the post 140. The tap 151 of the snap clamp 150 can be pressed around the neck 142 of the post 140 utilizing the quick release clipping mechanism 160, after receiving the neck 142 of the post 140 in the ring metal hole 111. The opening or rounded portion 151 of the snap clamp 150 can be designed in accordance with the structure of the post neck 142. The snap clamp 150 can be accessed with an index finger and slid away from the post to remove the ring metal 110 from the hardcover 210. The ring metal 110, the hardcover 210, the post 140 and the snap clamp 150 can be quickly separated into their perspective categories due to the clipping mechanism 160. Hence, all components of the ring binder apparatus 100 can be recycled without any damage to the components and without increasing development and production cost.

Referring to FIG. 2, a bottom view of the recyclable ring binder apparatus 100 in a fully opened position is illustrated, in accordance with a preferred embodiment. Note that in FIGS. 1-3 identical parts or elements are generally indicated by identical reference numerals. The ring binder apparatus 100 can be applied to office, industry and many other products that are permanently attached utilizing a combination of materials such as metal, paper or plastic. The ring binder apparatus 100 can be utilized to form, but not limited to books, booklets, clipboards and photo albums with the help of simple and easily detachable components. Therefore, the ring binder apparatus 100 can be recyclable, environment friendly, ecological, green and reusable.

Moreover, the hardcover 210 of the ring binder 100 can incorporate a front section 211, a spine section 212 and a back section 213 that are usually a rigid material (e.g. cardboard, plastic, or the like). The hardcover 210 can be designed as a chipboard and/or plastic board, where the plastic board can be constructed of bio-degradable or recycled plastics. The hardcover 210 can exhibit a uniform thickness throughout its length. The front section 211, the spine section 212 and the back section 213 can be entirely covered with decorative means. The front section 211 and the back section 213 can be connected to the spine section 212 at flexible hinge grooves 220. The hinge grooves 220 enable the hardcover 210 to bend or fold along the length of the grooves 220, so that the front section 211 and the back section 213 can be rotated between a closed position and an opened position, as illustrated in FIG. 2. It should also be understood that the hinge grooves 220, by the nature of their formation as thin portions of the hardcover 210, are not as strong the thicker portions of the hardcover 210 and thus are more prone to splitting or breaking.

The ring binder apparatus 100 can be formed by the ring metal 110 provided with the set of binder rings 120. The set of binder rings 120 of the ring metal 110 are openable and closable via the release levers 130. The ring metal 110 can be bonded with the hardcover 210 by utilizing the quick release clipping mechanism 160. The clipping mechanism 160 enables the user to press the opening or rounded portion 151 of the snap clamp 150 around the neck 142 of the post 140 after inserting the post 140, through the spine section 212, into the hole 111 in the ring metal 110. Such ring binders 100 can be easily detached for recycling without the need of additional tools and without affecting conformance of the binder components.

Figure 3:
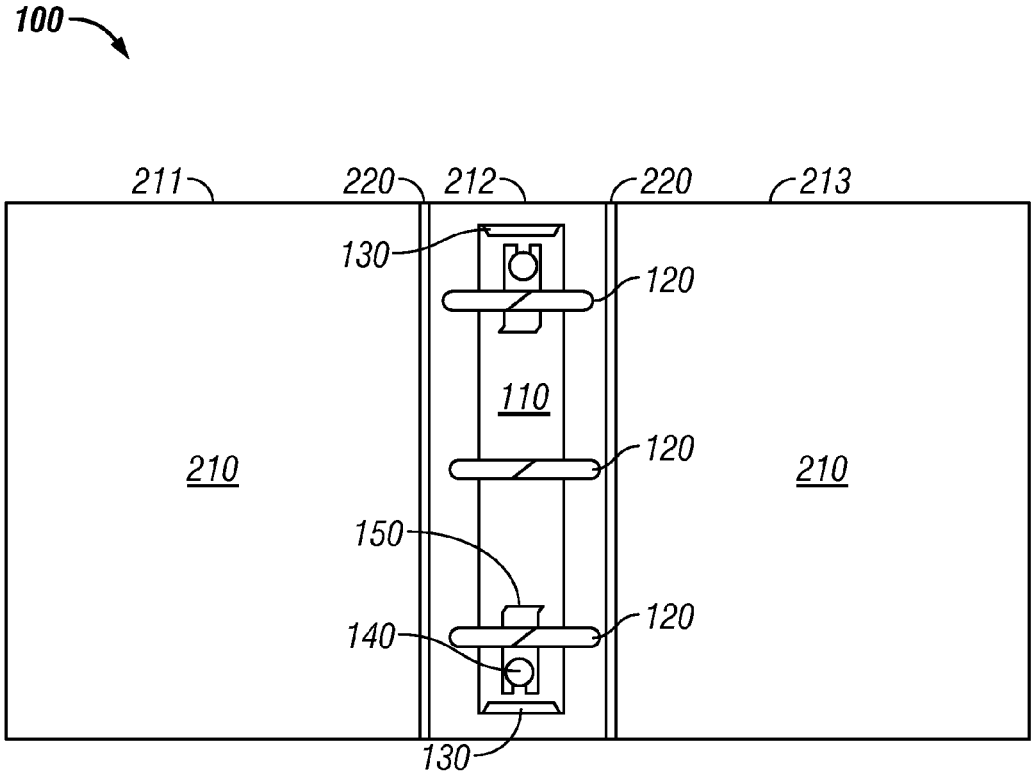
FIG. 3 illustrates a plan view of the recyclable ring binder apparatus in a fully opened position, in accordance with a preferred embodiment.

Referring to FIG. 3, a plan view of the recyclable ring binder apparatus 100 in a fully opened position, in accordance with a preferred embodiment. Note that in FIGS. 1-3 identical parts or elements are generally indicated by identical reference numerals. The ring binder apparatus 100 can incorporate the ring metal 110, the hardcover 210, and the clipping mechanism 160. Preferably, the hardcover 210 of the binder apparatus 100 can be constructed of a completely recyclable material such that no disassembly of the detached hardcover 210 can be required prior to recycling.

The post 140 and the snap clamp 150 can be made of metal and/or plastic depending upon design consideration. It can be appreciated, of course, that other materials may be utilized to implement the post 140 and the snap clamp 150. The hardcover 210 can be removably connected to the ring metal 110 with the help of clipping mechanism 160. The opening or rounded portion 151 of the snap clamp 150 can be disengaged and removed from the neck 142 of the post 140 to disconnect the hardcover 210 from the ring metal 110. Such a ring binder apparatus 100 can be engaged and disengaged virtually an unlimited number of times.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A recyclable ring binder apparatus, comprising:

a binder hardcover comprising at least one front section, at least one spine section and at least one back section, or any combination of such, wherein said binder hardcover is constructed of at least one recycled raw material;

a ring metal comprising a plurality of binder rings formed of a plurality of ring halves, a plurality of release levers wherein said plurality of binder rings is openable and closable via said plurality of release levers, and at least one hole; and at least one removable clipping mechanism including a post with a neck formed therein, and an arched snap clamp with a tab and a rounded opening, wherein said ring metal is firmly fastened to said at least one spine section of said binder hardcover by pressing said rounded opening of said arched snap clamp toward an end of said spine section around the neck of said post with the tab extending from the neck of the post toward the center of the spine section, and thereby said ring metal and said binder hardcover are easily detachable for recycling and for ease of separation and to leave said binder hardcover without any of said ring metal, parts associated with said ring metal, or said at least one clipping mechanism.

2. The apparatus of claim 1 wherein said arched snap clamp is accessible in order to slide said arched snap clamp away from said post in order to separate said ring metal from said binder hardcover.

3. The apparatus of claim 2 further comprising a second removable clipping mechanism including a second post with a second post neck formed therein, and a second arched snap clamp with a second clamp tab and a second clamp rounded opening, wherein said ring metal is firmly fastened to said at least one spine section of said binder hardcover by pressing said second clamp rounded opening of said second arched snap clamp toward a second end of said spine section around the second post neck of said second post with the second clamp tab extending from the second post neck of the second post toward the center of spine section.

4. The apparatus of claim 1 wherein said binder hardcover comprises a chipboard configured from a bio-degradable material that is recyclable.

5. The apparatus of claim 1 wherein said binder hardcover comprises a plastic board configured from recycled plastic that is recyclable.

6. The apparatus of claim 1 wherein said plurality of release levers is located at each end of said ring metal.

7. The apparatus of claim 1 further comprising a second removable clipping mechanism including a second post with a second post neck formed therein, and a second arched snap clamp with a second clamp tab and a second clamp rounded opening, wherein said ring metal is firmly fastened to said at least one spine section of said binder hardcover by pressing said second clamp rounded opening of said second arched snap clamp toward a second end of said spine section around the second post neck of said second post with the second clamp tab extending from the second post neck of the second post toward the center of spine section.

8. The apparatus of claim 1 wherein said hole is formed in said ring metal to receive said post.

9. The apparatus of claim 1 wherein said plurality of binder rings is spaced axially along a length of said ring metal.

10. A recyclable ring binder apparatus, comprising:

a binder hardcover comprising at least one front section, at least one spine section and at least one back section, or any combination of such, wherein said binder hardcover is constructed of at least one recycled raw material;

a ring metal incorporating a plurality of binder rings formed of a plurality of ring halves, wherein said plurality of binder rings is openable and closable via a plurality of release levers;

at least one removable clipping mechanism including a post with a neck formed therein, and an arched snap clamp with a tab, wherein said ring metal is firmly fastened to said at least one spine section of said binder hardcover by pressing said tab of said arched snap clamp toward an end of said spine section around the neck of said post with the tab extending from the neck of the post toward the center of the spine section, and thereby said ring metal and said binder hardcover are easily detached for recycling; and wherein said arched snap clamp is accessible in order to slide said arched snap clamp away from said post.

11. The apparatus of claim 10 wherein said plurality of release levers is located at each end of said ring metal.

12. The apparatus of claim 10 wherein said binder hardcover comprises biodegradable plastic.

13. The apparatus of claim 10 having said neck on one end of the post and a widened end on the opposite end of the post.

14. The apparatus of claim 10 wherein said hole is formed in said ring metal to receive said post.

15. The apparatus of claim 10 wherein said plurality of binder rings is spaced axially along a length of said ring metal.

16. A recyclable ring binder apparatus, comprising:

a binder hardcover comprising at least one front section, at least one spine section and at least one back section, or any combination of such, wherein said binder hardcover is constructed of at least one recycled raw material, wherein said binder hardcover comprises a plastic board configured from recycled plastic;

a ring metal incorporating a plurality of binder rings formed of a plurality of ring halves, wherein said plurality of binder rings is openable and closable via a plurality of release levers; and at least one removable clipping mechanism including a post with a neck formed therein, and an arched snap clamp with a tab, wherein said ring metal is firmly fastened to said at least one spine section of said binder hardcover by pressing said tab of said arched snap clamp toward an end of said spine section around the neck of said post with the tab extending from the neck of the post toward the center of the spine section, and thereby said ring metal and said binder hardcover are easily detached for recycling, leaving said binder hardcover without any of said ring metal, parts associated with said ring metal, or said clipping mechanism.

17. The apparatus of claim 16 wherein said arched snap clamp is accessible in order to slide said arched snap clamp away from said post in order to separate said ring metal from said binder hardcover.

18. The apparatus of claim 16 wherein said plurality of release levers is located at each end of said ring metal.

19. The apparatus of claim 16 having said neck on one end of the post and a widened end on the opposite end of the post.

20. The apparatus of claim 16 wherein said neck has a thick-thin-thick cross-section.

* * * * *